US005277113A

United States Patent [19]

Stearns et al.

[11] Patent Number: 5,277,113

[45] Date of Patent: Jan. 11, 1994

[54] OPTICAL DETECTION DEVICE

[75] Inventors: Edward J. Stearns; Robert H. Johnson, both of Scottsdale, Ariz.

[73] Assignee: Motorola, Inc., Schaumburg, Ill.

[21] Appl. No.: 900,804

[22] Filed: Jan. 25, 1991

Related U.S. Application Data

[62] Division of Ser. No. 532,778, Jun. 4, 1990, Pat. No. 5,142,985.

[51] Int. Cl.[5] ..... F42C 13/02

[52] U.S. Cl. ..... 102/213

[58] Field of Search ..... 102/211, 212, 213, 214; 244/3.16, 3.19

[56] References Cited

U.S. PATENT DOCUMENTS

| | | | |
|---|---|---|---|
| 3,554,129 | 1/1971 | Alpers | 102/213 |
| 4,159,476 | 6/1979 | Kohler | 102/214 |
| 4,223,607 | 9/1980 | Muller et al. | 102/213 |
| 4,232,609 | 11/1980 | Held | 102/214 |
| 4,309,946 | 1/1982 | Block | 102/213 |
| 4,627,351 | 12/1986 | Thordarson et al. | 102/213 |

FOREIGN PATENT DOCUMENTS

| | | | |
|---|---|---|---|
| 2258639 | 8/1975 | France | 102/213 |

*Primary Examiner*—Stephen M. Johnson
*Attorney, Agent, or Firm*—Frank J. Bogacz

[57] ABSTRACT

An advanced optical sensor for determining the standoff distance from a trajecting container to a target utilizes various checks and filters to eliminate false detonations caused by glint and counter-measures. The sensor is comprised of a transmitter, a receiver, and a wave generator. The wave generator generates a unique wave form which is relayed to both the receiver and the transmitter. The light emitted from the transmitted follows a pattern defined by the wave generator. When light is received by the receiver, a synchronous detector coupled to the wave form generator determines if the return light has a pattern correlating with the unique wave form from the wave generator. If so, the associated electric signal in the receiver must pass a predetermined threshold for a predetermined period of time before the sensor will generate a detonate signal.

2 Claims, 3 Drawing Sheets

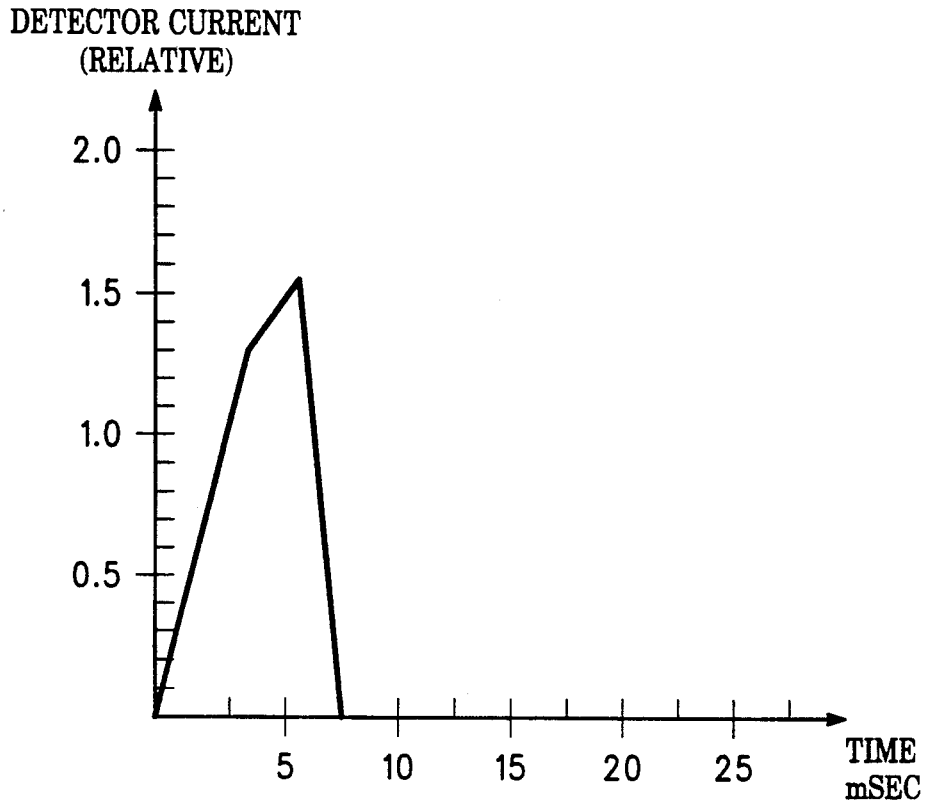
FIG. 2A
FIG. 2B
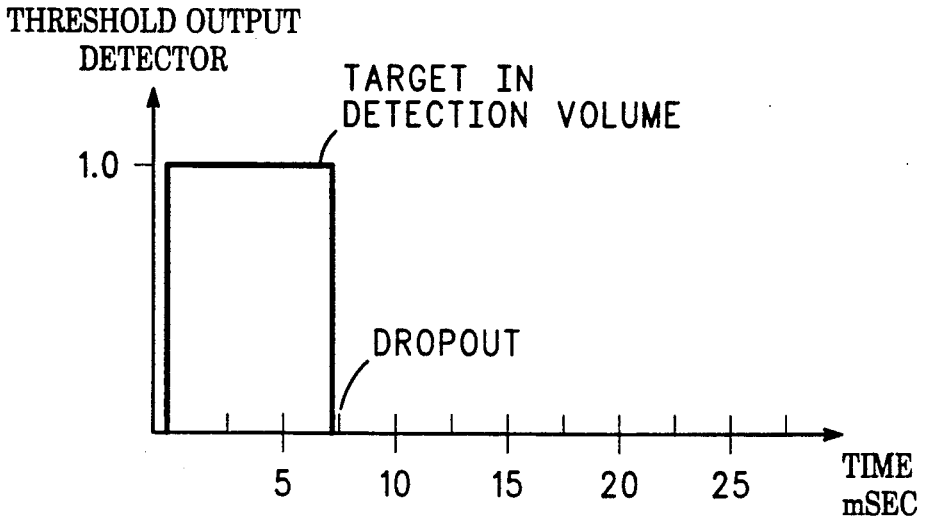

OPTICAL DETECTION DEVICE

This is a division of application Ser. No. 532,778, filed Jun. 4, 1990 now U.S. Pat. No. 5,142,985.

BACKGROUND OF THE INVENTION

This invention relates, in general, to optical detection devices.

With the diminishing of the historic cold war, new "battle fronts" have become of interest to the defense systems of many countries. For instance, protection of expatriates and diplomats in foreign countries against terrorist activities has become a fore-front interest to more advanced countries. Riot control and control of drug traffickers has also become a major interest to various governments. In these new "battle fields", harm to people and property should be minimized as much as possible.

As an example, in the area of drug trafficking, a U.S. federal agent may desire to temporarily disable an aircraft or helicopter in order to permit a search of the aircraft contents. Complete destruction of the aircraft is unnecessary and counter-productive, and extreme physical harm to individuals within the aircraft is generally undesirable. However, if the engines could be somehow jammed, the aircraft could be grounded long enough for officials to take control of the aircraft.

In the area of terrorism, historical incidents have shown that terrorists use vehicles, manned or unmanned, loaded with explosives, to penetrate protective barriers around diplomatic compounds. If the vehicle could be stopped, such as by jamming the engine of the vehicle, the danger to the facilities and personnel of such compounds could be eliminated. It would be far better to stop the vehicle in its forward progression leaving a safe distance between the vehicle and the compound than to cause an explosion at the barrier.

A device for accomplishing the above objectives would produce a cloud of material in close proximity to the vehicle or aircraft. When an aircraft is to be disabled, a cloud of coagulating substance could be dissipated within close proximity of the aircraft causing the jet/propeller engines to become jammed. The same principle could be used in stopping a moving vehicle. A coagulating material could be dissipated at the front of the vehicle. The material would then be taken into the engine, as the case with aircraft engines, through the air intake and generate a sludge in the engine cylinders. Accordingly, the engine would freeze and the vehicle would stop.

To ensure proper dissipation of the material, an engaging mechanism within the carrier device must dissipate the material before the carrier device reaches the aircraft/vehicle. If dissipated too early, the cloud could be avoided altogether by the aircraft/vehicle.

The time at which material is to be dissipated prior to reaching a target is known as stand-off. To achieve the right stand-off, sensors indicating proximity are incorporated.

Experience in sensor technology shows that optical sensors are more accurate and reliable than radar sensors in a high clutter environment. Optical sensors use transmit and receive optical lens to detect targets. A light beam is transmitted, and when reflected back from a target, is received by the receive optical lens telling the sensor a target has been detected. These optical sensors have some associated problems. A distant glint (intense sunlight reflections) may prematurely activate conventional optical sensors. Where such optical sensors have been used in battle, flares have been incorporated as defenses against optical sensors. Furthermore, white phosphorous gas (categorized as an aerosol) is used as a counter-measure to optical sensors. The aerosol reflects the light beam in a similar manner as would a target. The flares or aerosols prematurely detonate the optical sensors neutralizing the effect of the associated device.

SUMMARY OF THE INVENTION

Accordingly, it is an object of the present invention to provide an improved optical sensor which distinguishes the actual reflected light beam off of a target from glint, flares, or light reflected from aerosols.

An advanced optical sensor for determining the stand-off distance from a trajecting container to a target utilizes various checks and filters to eliminate false detonations caused by glint and counter-measures. The sensor is comprised of a transmitter, a receiver, and a wave generator. The wave generator generates a unique wave form which is relayed to both the receiver and the transmitter. The light emitted from the transmitter follows a pattern defined by the wave generator. When light is received by the receiver, a synchronous detector coupled to the wave form generator determines if the return light has a pattern correlating with the unique wave form from the wave generator. If so, the associated electric signal in the receiver must pass a predetermined threshold for a predetermined period of time before the sensor will generate a detonate signal.

The above and other objects, features, and advantages of the present invention will be better understood from the following detailed description taken in conjunction with the accompanying drawings.

BRIEF DESCRIPTION OF THE DRAWING

FIG. 2, A and B, graph outputs of various elements of the optical sensor according to the present invention.

DETAILED DESCRIPTION OF THE INVENTION

The present invention, in its preferred embodiment, relates to a stand-off sensor that detects the outside surface of a target and determines the range for optimum dispensing of the associated materials. The sensor utilizes a cross-beam, active optical sensing and key signal process to diminish false detonations from glint or optical counter-measures.

The key elements of the present invention sensor are as follows:

a) The optical system results in a small, controlled spatial sampling volume;

b) The sensor incorporates a modulation, demodulation scheme in the sensor transmitter and receiver;

c) A pre-synchronous detector band-width is controlled to limit response from uncorrellated optical inputs due to glint or other countermeasures;

d) A predetection filtering establishes the required target "build-up" and "decay" rates that will result in detection threshold crossings; and e) A post detection logic rejects false detonation from transient glint of the sun or other optical counter-measure techniques.

The present invention sensor possess three distinct capabilities:

1) The sensor reliably detects minimum reflectance targets in the presence of the densest aerosols anticipated from a study of recent countermeasure technologies;

2) The sensor rejects unmodulated or uncorrelated transient optical inputs; and

3) The sensor reduces the susceptibility of false detonation as the carrier passes through abrupt aerosol transitions.

Figure 1:
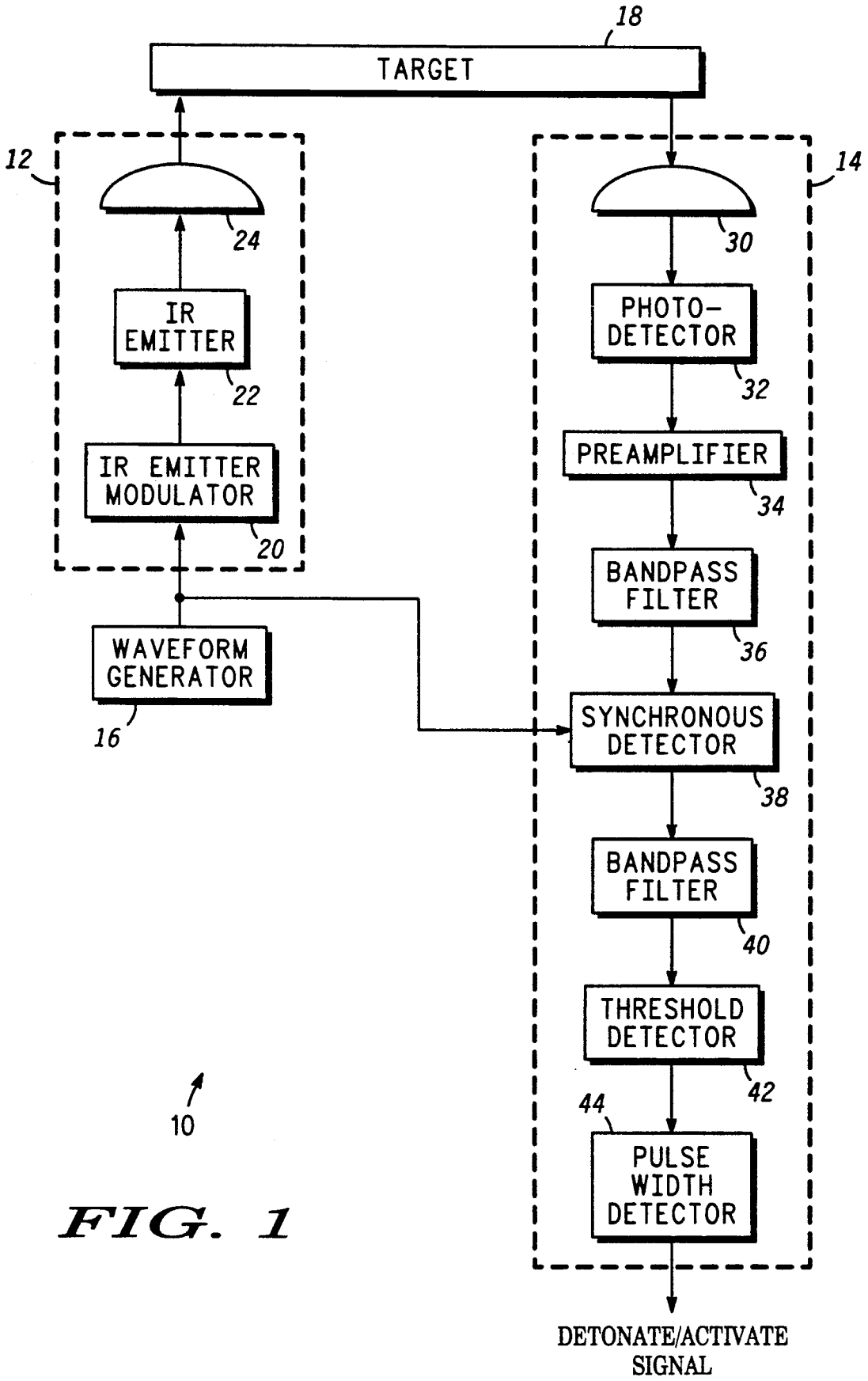
FIG. 1 is a schematic of an optical sensor according to the present invention.

FIG. 1 shows a schematic of an optical standoff sensor 10 according to the present invention. Generally, sensor 10 comprises an infrared (IR) transmit portion 12, an IR receive portion 14, and a wave-form generator 16. IR transmitter 12 and IR receiver 14 are both coupled to wave-form generator 16.

IR transmitter 12 comprises IR emitter modulator 20, IR emitter 22, and optic lens 24.

IR emitter modulator 20 is a transistor switch coupled to wave generator 16. Wave generator 16 generates unique waves which are received by IR emitter modulator 20. Each unique wave generated in wave generator 16 operates to activate and deactivate IR emitter modulator 20 in a sequence consistent with the amplitude of the unique wave. The electric current transmitted by IR emitter modulator 20 causes IR emitter 22, which is preferably a CW laser diode, to emit light according to the pattern of the unique wave. The light pattern from IR emitter 22 is transmitted out through optic lens 24 to a target 18.

IR receiver 14 comprises, in sequence, optic lens 30, photo-detect 32, preamplifier 34, band-pass filter 36, synchronous demodulator 38, band-pass filter 40, threshold detector 42, and pulse width detector 44.

When a beam of light, such as light reflected from target 18, is received by IR receiver 14, the light passes through optic lens 30 and is detected by photo-detector 32. Photo diode 32 is a light detecting diode which translates the light beam into an electric current signal. The signal is then amplified in preamplifier 34 and filtered through band-pass filter 36. Band-pass filter 36 removes image noise and transient signals outside a predetermined band width. It should be noted that the band-width must be wide enough to accommodate transient settling times within the band-width. By so doing, noncoherent light inputs will only result in signals crossing a given threshold in a period of time shorter than a subsequent minimum pulse width.

The signal is next relayed to synchronous detector 38. Synchronous detector 38 is coupled to wave form generator 16 to continuously receive the unique wave form generated therein. Synchronous detector 38 compares the wave form received directly from wave form generator 16 with the wave form of the signal from the light received by photo-detector 32. If the two wave forms are similar, synchronous detector 38 will pass an envelope signature of the received signal current on to band-pass filter 40.

Band-pass filter 40 filters the upper and lower amplitudes of the signal to output a signal similar to the signal shown in FIG. 2B. The upper limit of the filtered signal represents a predetermined threshold. The lower limit eliminates signals having continuous reflections rather than abrupt surfaces, and therefore would reject reflections from aerosols. The resultant signal from band-pass filter 40 is output to threshold detector 42. Threshold detector 42 produces a binary output which is at a low DC level when input signals are below a fixed voltage reference value. Threshold detector 42 is at a high DC level when input signals are above the reference value. The resultant signal from threshold detector 42 is output to pulse width detector 44. If the width of the resultant signal from threshold detector 42 is as wide as a predetermined width (end of the pulse width defined as the dropout point), an activate signal will be relayed from pulse width detector 44 to a dispensing/detonation device (not shown). If the signal is not as wide as the predetermined pulse width, no signal will be sent.

Figure 3:
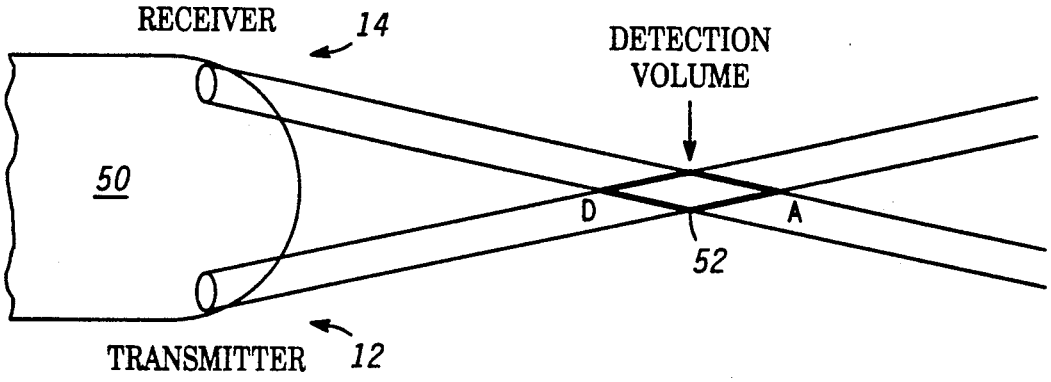
FIG. 3 shows a carrier incorporating the optical sensor according to the present invention.

The following discussion will provide a better understanding of the operation of sensor 10. Referring to FIG. 3, a carrier 50 is shown having IR receiver 14 and IR transmitter 12. IR transmitter 12 is continuously transmitting a beam of light according to the unique wave form generated in wave form generator 16 in FIG. 1. The design of optic lens 24 and optic lens 30 produces a crossed beam overlap 52 that is precisely positioned with respect to carrier 50 in FIG. 3. Overlap 52 is positioned to allow properly timed dispersion of the payload of carrier 50. Overlap 52 produces a detection volume wherein sensor 10 will determine a target.

A target will have an abrupt surface unlike aerosols which have continuous reflections as the carrier continues through its trajectory. As the surface of the target encounters overlap 52 at point A, light having the unique wave form from IR transmitter 12 will be reflected back to IR receiver 14. As the target continues through overlap 52, photo-detector 32 of FIG. 1 will generate a continually increasing current over time until the target surface reaches point D in FIG. 3. At this point, the current generated by photo-detector 32 will drop off suddenly. FIG. 2A shows the photodetector current output over time indicating the target's envelope signature of the target passing through overlap 52. The signal representing the envelope signature is amplified, demodulated through synchronous detector 38, and filtered through band-pass filters 36 and 40 to result in the signal of FIG. 2B. If the resultant signal has a magnitude equal to or greater than the threshold value of threshold detector 42 for a width as great as the required width of pulse width detector 44, sensor 10 will activate the dispersion mechanism of carrier 50.

The following discussions apply the principles of the above discussion of sensor 10 to show how glint, aerosol, and other countermeasure rejections are eliminated by sensor 10.

Glint and Countermeasure Rejection

The uniqueness of the unique wave form from wave form generator 16 allows IR receiver 14 to test for correlation within synchronous detector 38. Noncoherent optical inputs from glint or other countermeasures such as flares will result in short transients in the output of synchronous detector 38. The duration of the transients are inversely proportional to the band-width of band-pass filter 36. Since a minimum pulse width in pulse width detector 44 is required to activate the dispersion mechanism of carrier 50, the band-width of band-pass filter 36 must be wide enough to allow settling times of the transients. Noncoherent light inputs will therefore only result in short duration threshold crossings (threshold amplitude not sustained long enough to pass the minimum in pulse width detector 44) and will not activate the dispersion mechanism.

Aerosol Rejection

Aerosol reflections are rejected by utilizing the detection volume defined by the envelope signature of FIGS. 2A and B and using the lower filter range of band-pass filter 36 as a minimum. As carrier 50 enters into an area of heavy aerosol, the reflections from the aerosol will not be abrupt but will have a slow buil-up in intensity. Lack of the abrupt, intense reflections will cause an envelope signature has a slow rise time and a power spectral distribution in a manner that is suppressed by band-pass filter 36. The lower filter range will therefore eliminate almost all aerosol light reflections.

Those familiar in the art of optical sensors will recognize that the optical sensor described above may be used in many different applications where a carrier must release its payload at a given distance before a target. for instance, such a sensor could be utilized with shaped charges in projectile munitions.

Even though conventional optical sensors are more accurate and reliable than radar systems, conventional optical sensors are susceptible to glint, aerosol, and other countermeasures. However, the optical sensor described above in its preferred embodiment eliminates the problems associated with glint, aerosols, and other countermeasures by using a unique wave form coupled to the receive and transmit optics, and by passing the received light through various filters and checks.

Thus there has been provided, in accordance with the present invention, an optical sensor that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A method of dispersing a material from a trajecting carrier a predetermined distance from a target, the method comprising:

generating a unique wave form for subsequent correlation by a wave form generator;

transmitting a pulsating beam of light according to said unique wave form generated within a target sensor;

receiving light wave forms within a receiver of said target sensor;

receiving said pulsating beam of light within said receiver when said pulsating beam of light is reflected back to said target sensor;

comparing the wave form of all light wave forms received by said receiver with said unique wave form to select only said pulsating beam of light reflected back to said target sensor;

synchronously detecting said wave form generated by said wave form generator and said reflected pulsating light beam to correlate said transmitted and reflected lights beams;

generating an electric signal by a detector when an electrical signal associated with said reflected pulsating light beam correlates with the wave form of said pulsating beam of light;

determining if said electric signal exceeds a predetermined threshold over a predetermined time; and dispersing the material from the trajecting carrier when said electric signal exceeds said predetermined threshold over said predetermined time.

2. A method according to claim 1 wherein said step of determining if said electric signal exceeds a predetermined threshold over a predetermined time comprises the step of determining a pulse width by a pulse width detector wide enough to allow for settling of transient signals.

* * * * *